US005229235A

United States Patent [19]

Watanabe et al.

[11] Patent Number: 5,229,235

[45] Date of Patent: Jul. 20, 1993

[54] ELECTROPHOTOGRAPHIC PROCESS USING MELTED DEVELOPER

[75] Inventors: Haruo Watanabe; Masami Ohyama, both of Kanagawa; Akio Yasuda, Tokyo; Koichi Kawasumi, Kanagawa, all of Japan

[73] Assignee: Sony Corporation, Tokyo, Japan

[21] Appl. No.: 869,888

[22] Filed: Apr. 14, 1992

Related U.S. Application Data

[63] Continuation of Ser. No. 609,027, Oct. 30, 1990, abandoned, which is a continuation of Ser. No. 366,863, Jun. 15, 1989, abandoned.

[30] Foreign Application Priority Data

| | | | |
|---|---|---|---|
| Jun. 27, 1988 | [JP] | Japan | 63-156848 |
| Jun. 27, 1988 | [JP] | Japan | 63-156849 |
| Oct. 21, 1988 | [JP] | Japan | 63-264125 |
| Oct. 24, 1988 | [JP] | Japan | 63-267665 |
| Oct. 26, 1988 | [JP] | Japan | 63-268275 |
| Oct. 27, 1988 | [JP] | Japan | 63-271533 |

[51] Int. Cl.[5] ..... G03G 13/22; G03G 13/01

[52] U.S. Cl. ..... 430/45; 430/47; 430/112; 430/116; 430/117; 430/119; 430/124; 430/126

[58] Field of Search ..... 430/32, 45, 47, 112, 430/116, 117, 119, 126, 124

[56] References Cited

U.S. PATENT DOCUMENTS

| | | | |
|---|---|---|---|
| 3,247,007 | 4/1966 | Oliphant | 430/112 X |
| 3,254,997 | 1/1962 | Schaffert . | |
| 3,510,419 | 5/1970 | Carreira et al. | 430/34 |
| 3,512,965 | 5/1970 | Matkan | 430/119 |
| 3,776,723 | 8/1972 | Royka et al. . | |
| 3,820,985 | 6/1974 | Gaynor et al. | 430/47 |
| 4,337,303 | 6/1982 | Sahyun et al. | 430/117 X |

FOREIGN PATENT DOCUMENTS

| | | | |
|---|---|---|---|
| 0270728 | 4/1987 | European Pat. Off. . | |
| 1209881 | 1/1966 | Fed. Rep. of Germany | 430/119 |
| 2125013 | 12/1971 | Fed. Rep. of Germany | 430/126 |
| 1383780 | 11/1964 | France | 430/119 |
| 63-25670 | 7/1986 | Japan . | |

*Primary Examiner*—Roland Martin

*Attorney, Agent, or Firm*—Hill, Steadman & Simpson

[57] ABSTRACT

An electrophotographic process uses a developer in which the colorant is dispersed in an electrically insulating organic material being solid at room temperature and liquified by heating. The developer is superior in ease of handling and capable of producing stable images at all times. An electrostatic latent image is wet developed by the developer. For recording and preserving the developed image, it is transferred to a transfer substrate. The developed image is transferred by contact of a photoconductor with the transfer substrate, or by peeling a film from a photoconductor.

6 Claims, 12 Drawing Sheets

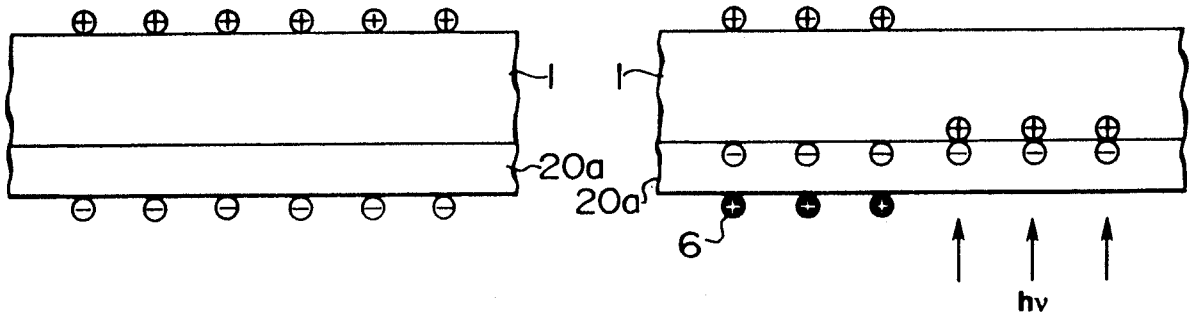
FIG. 14(A)
FIG. 14(B)
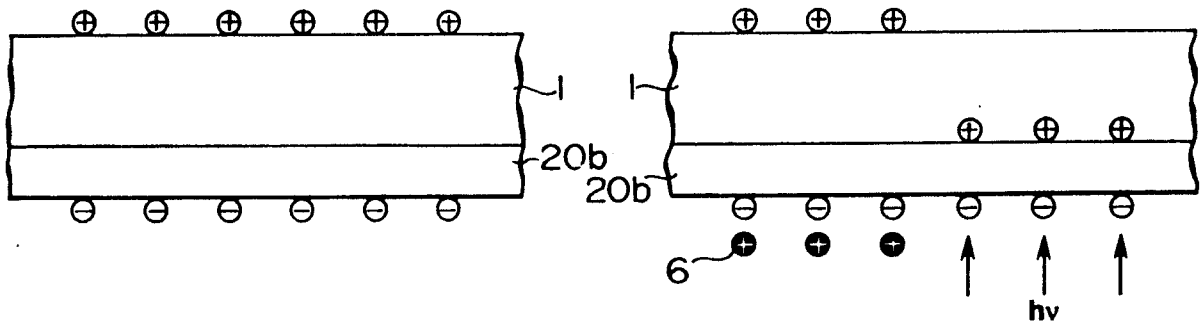
FIG. 15(A)
FIG. 15(B)

ELECTROPHOTOGRAPHIC PROCESS USING MELTED DEVELOPER

This is a continuation of application Ser. No. 609,027, filed Oct. 30, 1990, now abandoned, which is a continuation of application Ser. No. 366,836, filed Jun. 15, 1989, now abandoned.

BACKGROUND OF THE INVENTION

1. Field of the Invention

This invention relates to an electrophotographic process for recording and preserving an electrostatic latent image developed by wet development.

2. Description of the Related Art

In the field of image formation, a system in which a uniformly charged photoconductor is selectively irradiated with light as a function of image signals and an electrostatic latent image thus formed is developed is generally termed an electrophotographic process. This process may be roughly classified into either a dry developing method or a wet developing method.

The dry developing method has an advantage in that it is superior in the ease of handling and the stability of the toners used for development, since it is based on the principle that colorant particles are simply spread and affixed to an electrostatic latent image. However, dry developing is second to the wet development method in meeting the recent demand for high quality images, as exemplified by a video printer for taking an electronic still photograph.

On the other hand, the wet developing method makes use of a liquid developer which is produced by dispersing the dyestuff or pigment as the colorant in an insulating medium. According to the wet developing method, a resolution and gradation comparable to those of a silver halide photograph may be obtained, while the image exhibits superior weatherability when a pigment is used as the colorant.

The developer used in the conventional wet developing method contains an insulating medium which is liquid at room temperature, such as "Isopar G", a saturated hydrocarbon produced by Esso Inc., so that it is naturally liquid at room temperature (see FIG. 23).

However, the developing method employing a developer 5' which is liquid at room temperature is inconvenient to use since the developer can be handled only with difficulty and frequent maintenance is required for maintaining stable image formation.

In the preservation and supply of the wet developer, disadvantages are presented in connection with changes in the concentration thereof caused by cohesion or precipitation of the colorant particles and disposal of waste liquids.

The Japanese Kokai (Published Application) No. 25670/1988 discloses a method of developing an electrostatic latent image formed on the surface of a sensitized material wherein a toner is solidified and applied under pressure to the peripheral surface of a developing roll and the thus coated toner is dissolved by a developer and caused to flow into a space between the sensitized material and the developing roll.

In this reference, a developer such as "Isopar" is required for dissolving the solid toner, while a stable image cannot be obtained unless the supply of the developer is adjusted constantly.

For recording and preserving the electrostatic latent image in the visible form, it is preferably transferred to a suitable substrate. However, the conventional wet developing method is not necessarily suited to the purpose of forming a high quality image since the adsorption between the colorant particles and the sensitized material is so strong that the transfer efficiency is thereby lowered.

SUMMARY OF THE INVENTION

It is therefore an object of the present invention to overcome the above described deficiencies of the prior art and to provide an electrophotographic process for developing an electrostatic latent image which is superior in ease of handling and is capable of producing stable images at all times.

In view thereof, a method of the present invention is characterized in that the developer in which the colorant is dispersed is an electrically insulating organic material that is solid at room temperature and is liquefied by heating. The electrostatic latent image is wet developed by the thus liquefied developer.

The present invention also provides an electrophotographic process for image formation wherein an electrostatic latent image developer which is solid at room temperature and which is reversibly changed between the heated, melted state and the cooled, solidified state on a sensitized material is transferred to a substrate for forming a high quality image quickly at low costs and at high transfer efficiency.

The present invention also provides an electrophotographic process for image formation wherein an electrostatic latent image is formed on the surface of a film laminated on a sensitized material using the light of a wavelength capable of being transmitted through the film, the image thus formed is developed and the film is then peeled off from the sensitized material for forming a high quality image quickly at low cost and at high transfer efficiency.

BRIEF DESCRIPTION OF THE DRAWINGS

FIGS. 14(A) and 14(B) show diagrammatically the formation and elimination of electrical charges on a sensitized material on which is laminated an electrically conductive film having a dark decay time shorter than that of a sensitized material, wherein FIG. 14(A) corresponds to the charging step of FIG. 14(B) corresponds to the light exposure step.

FIGS. 15(A) and 15(B) show diagrammatically the formation and elimination of the electrical charges on a sensitized material on which is laminated an electrically insulating film having a dark decay time longer than that of the sensitized material, wherein FIG. 15(A) corresponds to the charging step of FIG. 15(B) corresponds to the light exposure step.

FIGS. 20(A), 20(B) and 20(C) show diagrammatically a transfer process embodying the present invention in the order of the consecutive steps, wherein FIG. 20(A) shows the stage of contact between the sensitized material and the substrate, FIG. 20(B) the stage of transfer of the developer and FIG. 20(C) the stage of peeling of the sensitized material from the substrate.

FIGS. 21(A), 21(B) and 21(C) show diagrammatically a transfer process embodying the present invention in the order of the consecutive steps, wherein FIG. 21(A) shows the stage of contact between the sensitized material and the substrate, FIG. 21(B) the stage of transfer of the developer by pressure applying means and FIG. 2(C) the stage of peeling of the sensitized material from the substrate.

FIGS. 22(A), 22(B) and 22(C) show diagrammatically the transfer process in an image forming method embodying the present invention, in the order of the consecutive steps, wherein FIG. 22(A) shows the stage of contact between the sensitized material and the substrate, FIG. 22(B) the stage of charging to an opposite polarity and FIG. 22(C) the stage of peeling from the substrate.

DETAILED DESCRIPTION OF THE PREFERRED EMBODIMENTS

Figure 1:
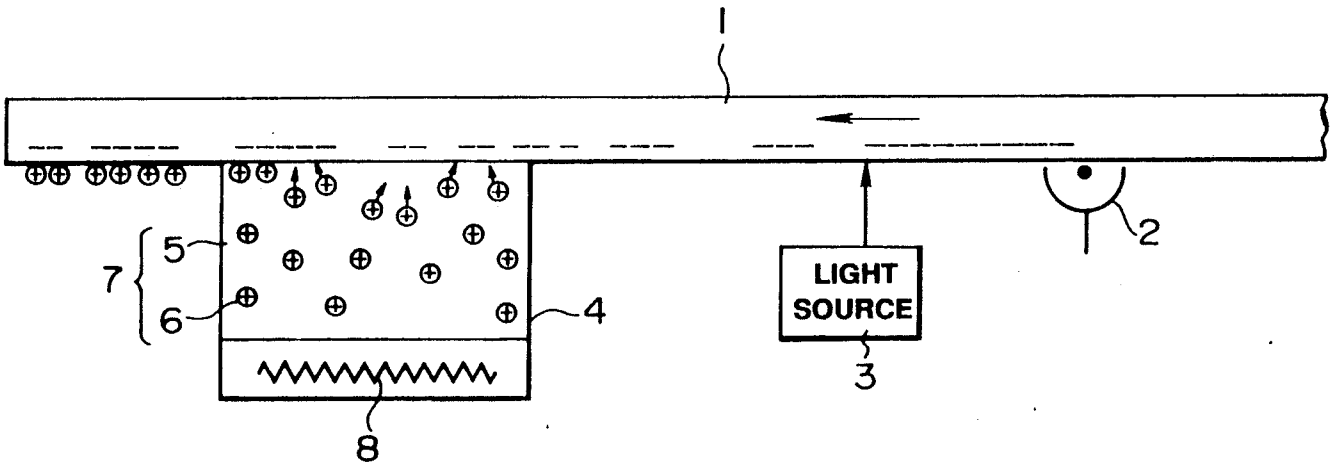
FIG. 1 is a diagrammatic view for illustrating the principle of the developing method of the present invention.

The principle of the developing method according to the present invention will be explained by referring to FIG. 1, in which the respective process steps are preferably successively applied to one long sensitized base material 1 for convenience.

In an electrical charging step, the sensitized base material 1 is electrically charged to a minus polarity by suitable charging means, such as a corona discharge member 2. At an ensuing exposure step, selective light exposure is performed in association with the image information, using suitable exposure means, such as semiconductor infrared laser light source 3, for eliminating negative charges of the area exposed to light.

Irrespective of the method for forming an electrostatic latent image or the kind of the sensitized base material 1, any well-known organic or inorganic photoconductive materials may be used for forming the base material 1. Examples of the well-known organic photoconductive materials now in use include eleotrophotographic sensitized base materials consisting of poly-N-vinyl-carbazole and 2,4,7-trinitrofluorene-9-on, poly-N-vinylcarbazole sensitized with pyrylium salt type colorant, poly-N-vinylcarbazole sensitized with cyanine type colorant, an electro-photographic sensitized base material consisting mainly of organic pigments of eutectic complexes consisting of colorants and resins. Examples of inorganic photoconductive materials include zinc oxide, zinc sulfide, cadmium sulfide, selenium, selenium-tellurium alloy, selenium-arsenic alloy, selenium-tellurium-arsenic alloy and amorphous silicon type materials.

At a subsequent developing step, the sensitized base material 1, on which the electrostatic latent image has been formed as described hereinabove, is passed over a developing tank 4. A developer 7 for the electrostatic latent image, which consists of an electrically insulating organic material 5 which is solid at room temperature and contains dispersed colorant particles 6 charged to a positive polarity, is contained in the tank 4, and is heated and melted by heating means 8 so that it is in the liquid state.

The developer 7 supplied to the developing tank 4 consists of colorant particles 6 dispersed in an electrically insulating organic material 5 which is solid at least at room temperature and which is changed between the solid and liquid states upon heating and cooling.

The electrically insulating organic material 5 has a melting point of not lower than 30° C. and preferably not lower than 40° C. in view of the ordinary operating environment and for ease of handling. Although there is no specific upper limit to the melting point, practically it is about 100° C. and preferably not higher than 80° C. when considering that additional energy is consumed for heating an insulating material 5 with too high a melting point. Also, the upper limit of the melting point should not exceed the heat resisting temperature of the material customarily employed as the base material when the organic material is held on a base material for use.

Among the materials meeting these requirements are paraffins, waxos and mixtures thereof. The paraffins include various normal paraffins with 19 to 60 carbon atoms, such as nonadecane to hexacontane. The waxes include plant waxes such as Carnauba wax or cotton wax, animal waxes such as bees wax, ozokerite, and petroleum waxes such as paraffin waxes, crystallite waxes or petrolatum. These materials are dielectrics having dielectric constants $\epsilon$ on the order of 1.9 to 2.3.

In addition, crystalline high molecular material having long alkyl groups at the side chains, such as homopolymers or copolymers of polyethylene, polyacrylamide, poly-n-stearyl acrylate or poly-n-stearyl methacrylate, such as copoly-n-stearyl acrylate ethyl methacrylate, may be employed. However, the aforementioned paraffins and waxes are preferred in view of their viscosity at the time of heating.

The colorant particles 6 dispersed into the electrically insulating organic material 5 may be organic or inorganic pigments or dyestuffs that are well-known in the art, or mixtures thereof.

The inorganic pigments include for example chromium type, iron type or cobalt type pigments, ultramarine or Prussian blue. The organic pigments or dyestuffs include Hansa Yellow (C. I. 11680), Benzidine Yellow G (C. I. 21090), Benzidine Orange (C. I. 21110), Fast Red (C. I. 37085), Brilliant Carmin 3B (C. I. 16015—Lake), Phthalocyanin Blue (C. I. 74160), Victoria Blue (C. I. 42595—Lake), Spirit Black (C. I. 50415), Oil Blue (C. I. 74350), Alkali Blue (C. I. 42770A), Fast Scarlet (C. I. 12315), Lodamin 6B (C. I. 45160), Lodamin Lake (C. I. 45160—Lake), Fast Sky Blue (C. I. 74200—Lake), Nigrocyn (C. I. 50415) or carbon black. These may be used alone or in combination. Those exhibiting desired coloration may be used selectively.

The developer may also contain resins, in addition to the electrically insulating organic materials 5 and colorant particles 6, for improving dispersibility or fixation of the colorants. These resins may be suitably selected from known materials and my include for example rubbers such as butadiene rubber, styrene-butadiene rubber, cyclized rubber or natural rubber, synthetic resins such as styrene, vinyl toluene, polyester, polycarbonate or polyvinyl acetate, rosin type resin, hydrogenated rosin type resin, alkyd resins containing modified alkyds, such as linseed oil, modified alkyd resins and natural resins such as polyterpenes. In additional phenol resins, modified phenol resins such as phenol formalin resins, phthalic acid pentaerythritol, Kumaronindene resins, ester gum resins or vegetable oil polyamide resins may also be useful. Halogenated hydrocarbon polymers, such as polyvinyl chloride or chlorinated polypropylene, synthetic rubbers such as vinyl toluenebutadiene or butadiene-isoprene, polymers of acrylic monomers having longchain alkyl groups, such as 2-ethylhexyl methacrylate, lauryl methacrylate, stearyl methacrylate, lauryl acrylate or octyl acrylate or copolymers thereof with other polymerizable monomers, such as styrene-lauryl methacrylate copolymer or acrylic acid-lauryl methacrylate copolymer, polyolefins such as polyethylene or polyterpenes, may also be employed.

The above developer is usually admixed with electrical charge donors. This applies for the developer employed herein. The electrical charge donors employed for this purpose include, for example, metal salts of fatty acids, such as naphthenic acid, octenic acid, oleic acid, stearic acid, isostearic acid or lauric acid, metal salts of sulfosuccinates, oil-soluble metal salts of sulfonic acid, metal salts of phosphates, metal salts of abietic acid, metal salts of aromatic carboxylic acid or metal salts of aromatic sulfonic acid.

For improving the charges of the colorant particles 6, fine particles of metal oxides, such as $SIO_2$, $AL_2O_3$, $TiO_2$, ZnO, $Ga_2O_3$, $In_2O_3$, $GeO_2$, $SnO_2$, $PbO_2$ or MgO, or mixtures thereof, may be employed as charge increasing additives.

Referring to the relative contents of the above ingredients, the colorant particles 7 are employed preferably at a rate of 0.01 to 100 g, and more preferably at a rate of 0.1 to 10 g, to 1 liter of the electrically insulating organic material 5 in the melted state, while the charge donors are employed usually at a rate of 0.001 to 10 g, and preferably at a rate of 0.01 to 1 g, to 1 liter of the organic material 5. The charge increasing additive is added in an amount of not more than the same amount, as that of the colorant particles 6.

The above developer may be heated by the heating means 8 into the melted state. The heating temperature may be suitably set in dependence upon, for example, the melting point, and may usually be 30° to 130° C. and preferably be 40° to 110° C.

When the liquefied developer 7 is contacted with the sensitized base material 1, the colorant particles 6 migrate towards and are deposited at the negative electrical charges.

Finally, the colorant particles 6 affixed to the unnecessary portion in the course of the fixation process are eliminated and, after the process of elimination of the electrical charges, the image is formed on the sensitized base material.

Meanwhile, when the sensitized base material 1 and the developer 7 are solidified immediately after contact, the image tends to be degraded in quality. It is therefore preferred to provide heating means for heating either the sensitized base material 1 itself or a stage to which the sensitized base material 1 is secured.

The heating temperature for the sensitized base material 1 may be suitably set in dependence upon the kinds and characteristics of the sensitized material used. It is preferably not lower than the liquidus temperature of the developer 7 and is usually set in the range from room temperature to 130° C., and preferably in the range of 30° to 110° C.

The development may be monochromatic or may form a full color image using developers of various colors, such as yellow, magenta and cyan. In this case, the above described developing process may be performed repeatedly for each of the color developers, and the developing sequence is selected as a function of, for example, the kind of the light source used for sensitization. For example, when an IR laser or a UV laser is employed, the sequence is yellow-magenta-cyan or cyan-magenta-yellow, respectively. If necessary, inking may be performed with black color and, in such case, the black color may be developed at a suitable point in the course of the development of the various colors.

The developing method of the present invention may be applied for developing an electrostatic latent image formed by means other than sensitization, such as by electrification of a dielectric material by an electrifying needle.

Although the developer 7 may be accommodated in the tank 4, as described above, it may also be carried on a suitable base in the form of a sheet- or tape- like developing material. In this case, the ease of handling of the developer is improved significantly.

Figure 2:
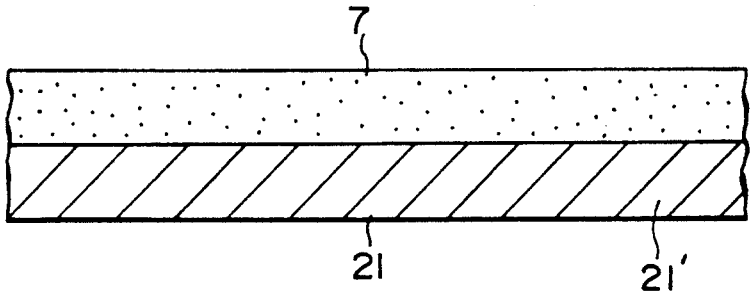
FIG. 2 is an enlarged cross-sectional view showing essential parts of an embodiment of a developing material comprised of a base material having its overall surface coated with a developer.

FIG. 2 shows the simplest form of the development material wherein the developer 7 is coated on the overall surface of a sheet-like base material 21.

The base material 21 may be made of a high molecular film, such as polyethylene terephthalate, polypropylene, polycarbonate or polyamide, papers such as natural or synthetic paper, cloths or non-woven cloths formed of natural fibers, such as plant fibers exemplified by cotton or hemp or animal fibers exemplified by silk or wool, cloths or non-woven cloths formed of synthetic fibers including organic fibers such as polyamide, polyester, polyacetal or polyurethane and inorganic fibers such as glass, ceramics or carbon, meshes of metals or organic high molecular materials or a high molecular foam such as polyurethane foam.

Figure 3:
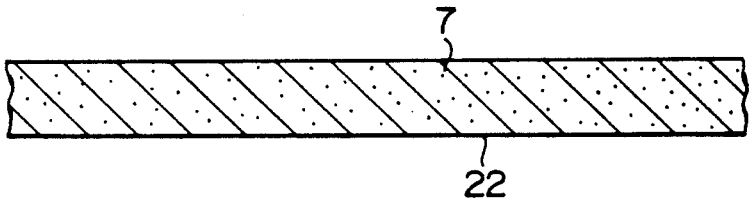
FIG. 3 is an enlarged cross-sectional view showing essential parts of an embodiment of a developing material comprised of a porous base material impregnated with a developer and solidified

FIG. 3 shows an example of a porous base material 22, wherein the developer 7 is impregnated and solidified in the porous base material 22.

Figure 4:
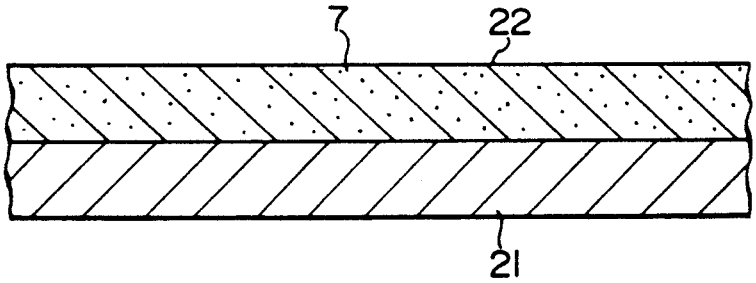
FIG. 4 is an enlarged cross-sectional view showing essential parts of an embodiment of a porous base material impregnated with a developer, solidified and backed with a sheet-like base material.

The porous base material 22 in which the developer 7 is impregnated and solidified may be backed and reinforced by a sheet-like base material 21, as shown in FIG. 4.

A bias voltage may be easily applied at the time of development by affording electrical conductivity to the base material when formed into a tape or a sheet.

The base material afforded with electrical conductivity includes both a base material exhibiting electrical conductivity and a non-conductive base material on which an electrically conductive layer is formed.

In FIG. 2, the sheet-like base material 21 used is a sheet-like electrically conductive base material 21' and the developer 7 is coated on the overall surface of the base material 21'.

The electrically conductive base material 21 may, for example be Al, Cu, stainless steel, electrically conductive ceramics, carbon, SiC, indium tin oxide (ITO), $SnO_2$ or electrically conductive high molecular materials.

Figure 5:
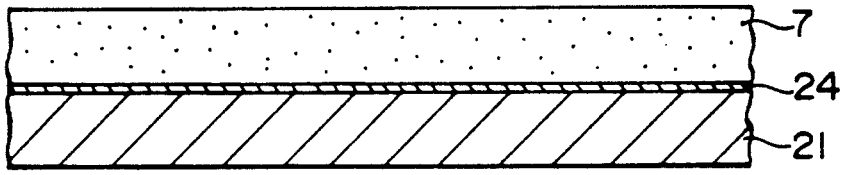
FIG. 5 is an enlarged cross-sectional view showing essential parts of an embodiment of a developing material comprised of a base material having an electrically conductive layer and coated on its overall surface with a developer.

When the base material itself is not afforded with electrical conductivity, an electrically conductive layer 24 may be formed on the surface of the base material 21 and the developer 7 may then be formed on the conductive layer 24, as shown in FIG. 5.

The conductive layer 24 is formed by evaporation, sputtering or plating of metals or by coating of a material in which electrically conductive particles are dispersed, such as a silver paste.

Figure 6:
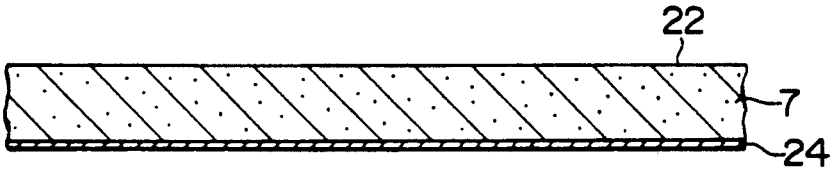
FIG. 6 is an enlarged cross-sectional view showing essential parts of an embodiment of a porous base material impregnated with a developer, solidified and coated on its reverse side with an electrically conductive layer.

FIG. 6 shows an example of a porous base plate 22, in which the developer 7 is impregnated and solidified. In this example, an electrically conductive layer 24 is formed on the reverse side of the porous base plate 22 to provide for electrical conductivity.

Figure 7:
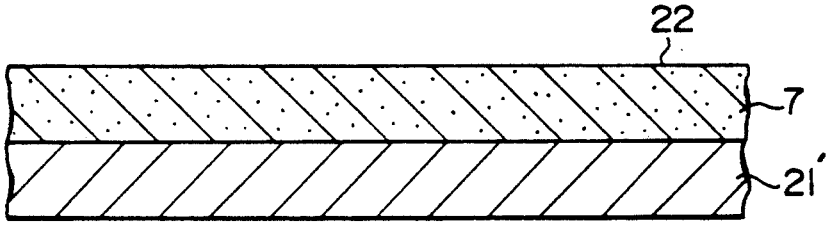
FIG. 7 is an enlarged cross-sectional view showing essential parts of an embodiment of a porous base material impregnated with a developer, solidified and backed with an electrically conductive base material.

The porous base plate 22, in which the developer 7 is impregnated and solidified in the above described manner, may be backed with a sheet-like electrically conductive base material 21', as shown in FIG. 7, to provide for reinforcement and electrical conductivity.

The porous base plate 22, in which the developer 7 is impregnated and solidified in the above described manner, may be backed with a sheet-like electrically conductive base material 21', as shown in FIG. 7, to provide for reinforcement and electrical conductivity.

Figure 8:
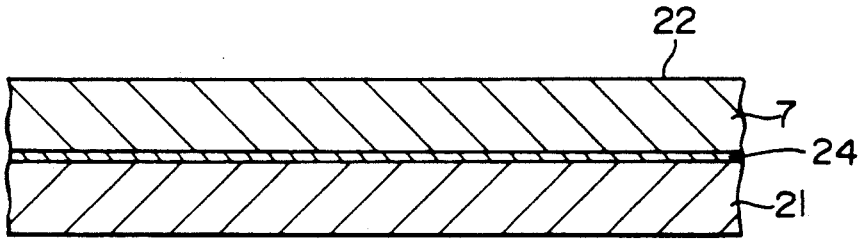
FIG. 8 is an enlarged cross-sectional view showing essential parts of an embodiment of a porous base material impregnated with a developer, solidified and backed with a base material having an electrically conductive layer.

Also, as shown in FIG. 8, a porous base plate 22 in which the developer 7 is impregnated and solidified in the above described manner may be laminated with the base plate 21 provided with the electrically conductive layer 24.

Also developers of plural colors may be incorporated into the base materials 21 or 21' of the porous base material 22 when the base materials are formed into sheets or tapes and zones of the different colors may be formed by coating on one and the same base material.

Figure 9:
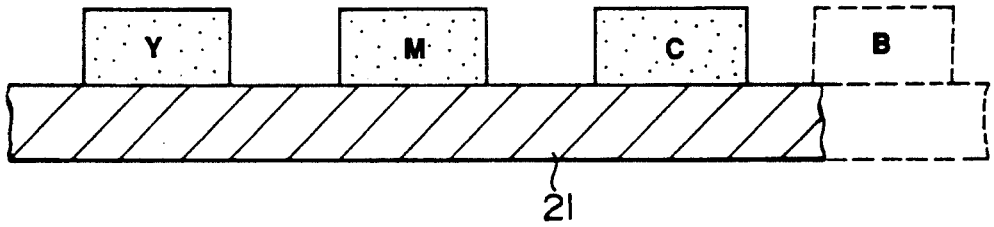
FIG. 9 is an enlarged cross-sectional view showing essential parts of an embodiment of a developing material having plural developer regions formed thereon.

In FIG. 9, for example, a yellow-color developer layer Y, a magenta color M and cyan color developer layer C are formed on the base material 21 to provide for full-color image formation. When forming the full-color image, a zone for a black developer layer B may be annexed beside the yellow, magenta and cyan colors, if so desired.

Figure 10:
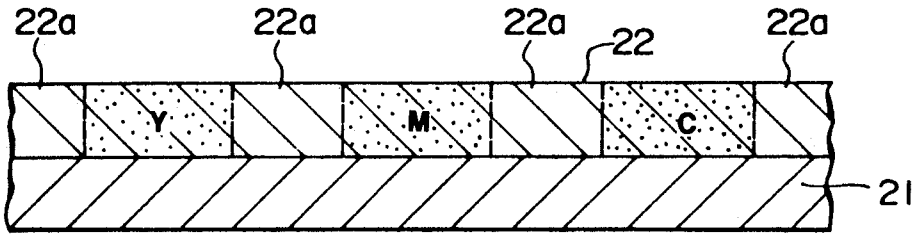
FIG. 10 is an enlarged cross-sectional view showing an embodiment of a porous base material backed with a sheet-like substrate and having plural developer regions formed thereon
Figure 11:
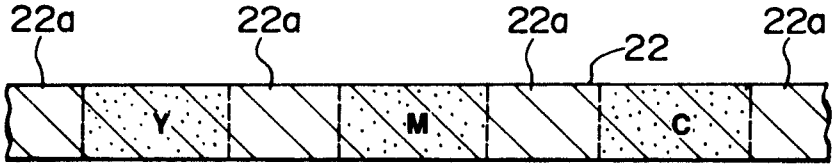
FIG. 11 is an enlarged cross-sectional view showing essential parts in which a porous base material having plural developer regions formed therein is used directly as the developing material.

Similarly, as shown in FIG. 10, a yellow color developer Y, a magenta color developer M and a cyan color developer C may be impregnated and solidified in separate regions on the porous base material 22 laminated on the base material 21. Regions 22*a* of the porous material 22 between the developer regions Y, M and C are free of developer. Of course, as shown in FIG. 11, the porous base material 22 in which the yellow color developer Y, magenta color developer M and the cyan color developer C are impregnated and solidified may be directly used as the developer for developing the electrostatic latent image.

Meanwhile, when plural developer regions are formed on one and the same base material, color mixing may be caused during, above all, heating and melting.

Figure 12:
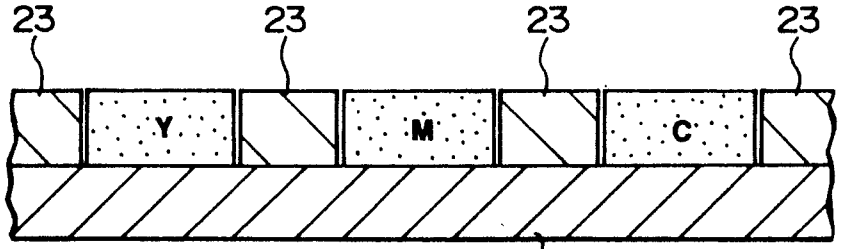
FIG. 12 is an enlarged cross-sectional view showing an embodiment of a developing material having plural developer regions with a color mixing inhibit layer.

Thus, as shown in FIG. 12, a color mixing inhibit layer 23 is provided in between the regions consisting of the developers Y, M and C.

This color mixing inhibit layer 23 may be of any type so long as it functions as a spacer. Above all, a liquid absorbing material, such as that similar to the aforementioned porous base material 22, or a liquid repellent material may be employed.

When the developers Y, M and C of the respective colors are impregnated and solidified into porous base material 22, as shown in FIGS. 10 or 11, these regions of the developers of the various colors may be formed at a predetermined interval from one another so that the portions of the porous base material 22*a* delimited between these regions act as the color mixing inhibit layers.

For recording and preserving the developed electrostatic latent image in a state in which it can be seen readily, it is transferred to a suitable substrate. As transfer method, a method (a) consisting of providing heating means at a stage supporting a photosensitive member 1 and the developer 7 is contacted with the substrate as the developer is heated and melted, or a method (b) consisting of pressuring the substrate by means such as a roll as the developer is cooled and solidified are contemplated. In the above method (a), the heating temperature of the photosensitive member 1 may be suitably set as a function of the kinds and characteristics of the photosensitive member 1, and is preferably in the range from 30° to 110° C.

In the above method (a), when the developer 7 is contacted with the substrate as the developer 7 is heated to the melted state, and the substrate opposite to the member 1 is charged to a polarity opposite to that of the colorant particles, the transfer efficiency of the image to the substrate is improved. For applying these electrical charges of the opposite polarity, suitable means of electrification, such as a corona discharge body, may be employed.

The material used as the substrate may be selected suitably, depending on usage, as long as it can be impregnated to a more or less great degree with the electrically insulating organic material. Examples of this material include various papers materials, such as natural or synthetic paper, cloths or non-woven cloths formed of plant fibers such as cotton or hemp or animal fibers such as silk or wool, cloths or non-woven cloths formed of organic synthetic fibers such as polyamide, polyester, polyacetal or polyurethane or inorganic fibers such as ceramics or carbon, meshes such as metals or organic high molecular materials, or high molecular foams, such as polyurethane foams. For preserving the substrate in the form of a document, a paper sheet of a white ground is preferably employed as the substrate in view of higher visibility. The present invention is, however, not limited to this exemplary embodiment.

Figure 13:
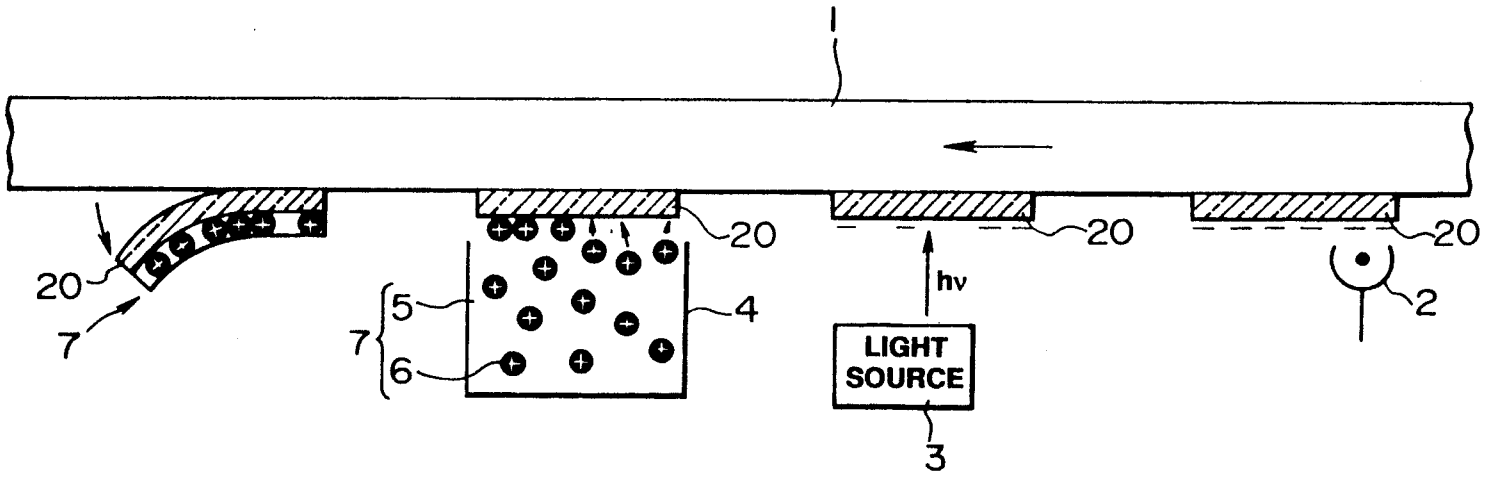
FIG. 13 is a diagrammatic view for illustrating the principle of the developing method for an electrostatic latent image forming the pre-stage of image formation.

As an image forming method for high speed formation of a high quality image at low costs and high transfer efficiency, a method is provided consisting of laminating a film 20 which is able to transmit light from a light source 3 onto a sensitized material 1, exposing the film to light hv for forming an electrostatic latent image on the film developing the latent image and peeling the film 20 from the sensitized material 1 (FIG. 13).

As methods for forming the image at this time, a method (a) consisting of laminating an electro-conductive film which is shorter in dark decay time than the photosensitized material, or a method (b) consisting of laminating an insulating film longer in dark decay time than the sensitized material. The dark decay time herein means the time interval during which the electrical charges on a material are reduced to one half when the material, which has been previously electrified to certain constant charges, is allowed to stand in the dark.

Possible mechanisms of charge formation and extinction in method (a) are described below referring to FIGS. 14(A) and 14(B).

As shown in FIG. 14(A), the surface of an electrically conductive film 20*a* is electrified by corona discharge or by laser irradiation to a uniform negative charge. At this time, the positive electrical charges are induced on the sensitized material 1 opposite to the electrically conductive film 20*a*.

When a selective laser irradiation is then performed, as shown in FIG. 14(B), the laser light hv passes through the electrically conductive film 20*a* to reach the sensitized material 1. At this time, the negative charges on the surface of the electrically conductive film 20*a* are conducted in the direction of the film thickness towards the boundary between the film 20*a* and the sensitized material 1, while, on the side of the sensitized material, the positive charges or holes migrate towards the boundary only at the laser irradiated zone. The result is that, in the region in which the positive charges have migrated, the charges are neutralized and the potential is reduced to zero on the boundary, whereas, in the region in which the positive charges have not migrated, there exists a constant potential. Thus, the colorant particles 6, charged to the positive potential, are selectively affixed to the region not irradiated by the laser light hv, (as shown on the left side of FIG. 14(B)), whereas the colorant particles do not become affixed to the region where the potential has been reduced to zero by irradiation hv (as shown on the right side of FIG. 14(B)).

This becomes possible since the dark decay time of the electrically conductive film 20*a* is selected to be shorter than that of the sensitized material 1. If the dark decay time of the sensitized material 1 is shorter than that of the film 20*a*, then there is the risk that the positive charges will be dissipated before laser light irradiation and the potential distribution cannot be formed. In short, what is critical in the present invention is that the potential distribution as shown in FIG. 14(B) is formed and maintained substantially unaltered until immediately before development of the electrostatic latent image.

As may be realized from the foregoing description with reference to FIG. 13, a time t equal $t_1+t_2+t_3+t_4$ is required to elapse until the electrostatic latent image is formed, wherein $t_1$ is the time involved in corona charging, $t_2$ is the time which passes from the corona charging step until the exposure step, $t_3$ is the time involved in exposure to light, and $t_4$ is the time which passes from the exposure step until the developing step. Hence, from a more practical standpoint, it suffices if the dark decay time of the electro-conductive film 20*a* is shorter that the above time t.

According to the present invention, as described hereinabove, the electrostatic latent image is developed on the surface of the electrically conductive film 20*a* and then the film 20*a* is peeled off from the sensitized material 1. If the film 20*a* is rigid enough to be used by itself for preservation and perusal, it may be used directly, as for example in the case wherein the film 20*a* is used directly as the sheet for an overhead projector (OHP). Alternately, the film 20*a* may be bonded to the substrate with the image forming surface of the film 20*a* in contact with the substrate, in which case the film 20*a* acts as the protective film so that a so-called laminate coating may be achieved simultaneously with the image transfer.

The material that may be used as the substrate may be selected suitably according to usage as long as it can be impregnated with the aforementioned insulating dispersion medium. Examples of this material include various paper materials, such as natural or synthetic paper, cloths or non-woven cloths formed of plant fibers such as cotton or hemp or animal fibers such as silk or wool, cloths or non-woven animal fibers such as silk or wool, cloths or non-woven cloths formed of organic synthetic fibers such as polyamide, polyester, polyacetal or polyurethane or inorganic fibers such as ceramics or carbon, meshes such as metals or organic high molecular materials, or high molecular foams, such as polyurethane foams. For preserving the substrate in the form of a document, a paper sheet of a white ground is preferably employed as the substrate in view of higher visibility. It is however not limiting of the present invention. By bonding the film 20*a* in this manner to a suitable substrate, a transfer efficiency of 100% is achieved, so that the sensitized materials 1 can be re-used.

The aforementioned organic or inorganic electrically conductive materials may be used as the sensitized material 1, as long as the material 1 is selected so that it has a dark decay time longer than that of the electrically conductive film laminated thereon. The dark decay time for the exemplary sensitized materials is about 300 seconds for polyvinyl-N-carbazole, 100 seconds for phthalocyanin, 20 to 30 seconds for amorphous selenium, and 30 to 40 minutes for the resin dispersion system of zinc oxide.

Among the properties required of the electrically conductive film is its ability to transmit the light from the exposure light source. Therefore, it is not always-necessary that the film is colorless when specific effects or decorative usage are desired. On the other hand, it is necessary for the above electrically conductive film to have a shorter dark decay time than that of the sensitized material. This dark decay time depends, for example, on the film thickness. For example, a polyethylene film that is 9 μm thick having a dark decay time at 25° C. of about 6.5 seconds is most preferred. In addition, polypropylene, poly-2-cyanomethyl acrylate, polybenzyl acrylate, poly-4-butylstyrene or a polyvinylidene chloride-polyvinyl chloride copolymer may be employed.

A shorter dark decay time means a correspondingly higher electrical conductivity. The aforementioned materials for the electrically conductive film are generally organic high molecular materials, such as plastics, having glass transition points Tg proper thereto. The organic high molecular materials are known to be changed drastically in their physical properties, inclusive of the electrical conductivity, on both sides of the glass transition point Tg. Polyethylene, for example, has a glass transition point Tg of −100° C. which is much lower than room temperature, so that it exhibits sufficient electrical conductivity at room temperature (25° C.). The dark decay time as measured with a film that is 9 μm thick is about 6.5 seconds, which is shorter than the dark decay time of the ordinary sensitized materials. Thus, polyethylene is suitable as the material of the electrically conductive material according to the present invention. However, some of the organic high molecular materials have a glass transition point Tg close to room temperature. These materials do not exhibit sufficient electrical conductivity at or near room temperature. According to the present invention, these materials having a higher glass transition point are heated to lower their dark decay time, so that these materials may also be used as the electrically conductive film. As will be apparent from the above explanation, the heating temperature at this time is selected to at least be not lower than the glass transition point Tg and preferably 20° to 30° C. higher than the glass transition point Tg. At any rate, the dark decay time of the electrically conductive film is set so as to be at a desired value within the range shorter than that of the sensitized material. Examples of organic high molecular materials, and their glass transition points, that may be employed in the present invention include polypropylene (−8° C.), poly-2-cyanomethyl acrylate (4° C.), polybenzyl acrylate (6° C.), poly-4-butylstyrene (6° C.), a polyvinylidene chloride-polyvinyl chloride copolymer (10° C.), poly-4-butoxycarbonyl phenyl acrylate (13° C.), polyfluoro methyl acrylate (15° C.), polyhexadecyl methacrylate (15° C.), polycyclohexyl acrylate (17° C.), polymethyl acrylate (17° C.), polyneopentyl acrylate (22° C.), polycyano methyl acrylate (23° C.), polypropyl-2-propylene (27° C.), polyisobutyl ethylene (29° C.) and poly-3-ethylstyrene (30° C.). The temperatures within the parenthesis denote the glass transition points Tg for each material.

The preestimated mechanism for generation and elimination of the electrical charges in the method (b) is hereinafter explained with reference to FIGS. 15(A) and 15(B).

As shown in FIG. 15(A) the surface of the insulating film 20*b* is charged to a uniform negative polarity by corona discharge. At this time, positive charges are induced on the sensitized material opposite to the insulating film 20*b*.

Then, as shown in FIG. 15(B), selective laser irradiation is performed, whereby the laser light hv passes through the insulating film 20*b* to reach the sensitized material 1. Due to its properties, the insulating film 20*b* is unable to shift the negative charges existing in the vicinity of its surface along the film thickness, so that the positive charges migrate to close to the boundary between the film 20*b* and the sensitized material 1 in the regions irradiated with the laser light. The result is that a region of different potentials, that is, the distance of the negative and positive charges, is locally produced within the laminated material. In short, the colorant particles 6 charged to the positive polarity are selectively affixed to the non-irradiated region, but are not affixed to the region when the distance between the two charge types is reduced by irradiation and which may be deemed to be roughly neutral electrically.

This is made possible in that the dark decay time of the insulating film 20*b* is selected to be longer than that of the sensitized material 1. Should the dark decay time of the insulating film 20*b* be shorter, the negative charges are dissipated before irradiation of the laser light so that the desired potential distribution cannot possibly be achieved.

In the above summary of the mechanism for the formation and disappearance of the electrical charges, some residual potential unavoidably exists at the exposed region produced by laser light irradiation. This residual potential presents practically no disadvantage since it can be cancelled by the application of a bias voltage to, for example the developer side.

In this manner, according to the present invention, the electrostatic latent image is developed on the surface of the insulating film 20*b* and the film is subsequently peeled off from the sensitized material 1. The insulating film 20*b* may be used directly, as in the above described electrically conductive film, or it may be bonded to another suitable substrate. The method (a) and the materials shown therein may be used for bonding.

The aforementioned organic or inorganic electrically conductive materials may be used as the sensitized material 1, as long as the material 1 is selected so that is has a dark decay time longer than that of the electrically insulating film laminated thereon.

Among the properties required of the electrically insulating film is its ability to transmit the light from the exposure light source. Therefore, it is not always necessary that the film is colorless when specific effects or decorative usage are desired. On the other hand, it is necessary for the above electrically conductive film to have a longer dark decay time than that of the sensitized material. For example, polyethylene terephthalate having a dark decay time of about 400 seconds is preferred. Other materials such as polystyrene, polyphenylene sulfide, polyimide of polyamide, may also be employed.

Figure 16:
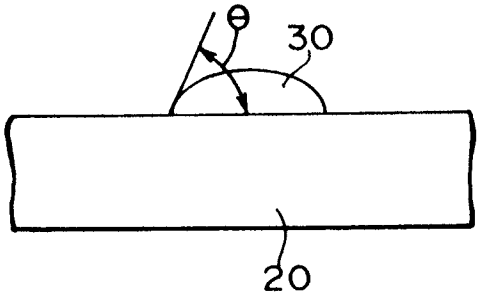
FIG. 16 is an enlarged view showing diagrammatically the state of affixture of methylene iodide on the film surface.

Since the image is formed directed on the laminated film on the sensitized material, an image of a higher quality may be obtained when the film exhibits higher wettability with respect to the developer, whether the film is the electrically conductive film or the electrically insulating film. For meeting the above requirements, it is required that the contact angle with respect to methylene iodide be of not more than 60° C. In FIG. 16, the contact angle with respect to methylene iodide defines an angle $\theta$ to the surface of the film 20 as measured between a tangential line drawn at a contact edge of the methylene iodide 30 and the plane of the film 20. When this contact angle $\theta$ is of not less than 60°, a high quality image cannot be obtained because of poor wettability with respect to the developer. Among the materials satisfying these conditions are polyethylene, polyvinylidene chloride-polyvinyl chloride copolymer, polyvinyl chloride (PVC), polyimide, polyamide and polypropylene. The film employed herein need have a contact angle with methylene iodide of not more than 60° at the operating temperature.

EXAMPLE 1

A developing apparatus used in the present example will now be explained.

Figure 17:
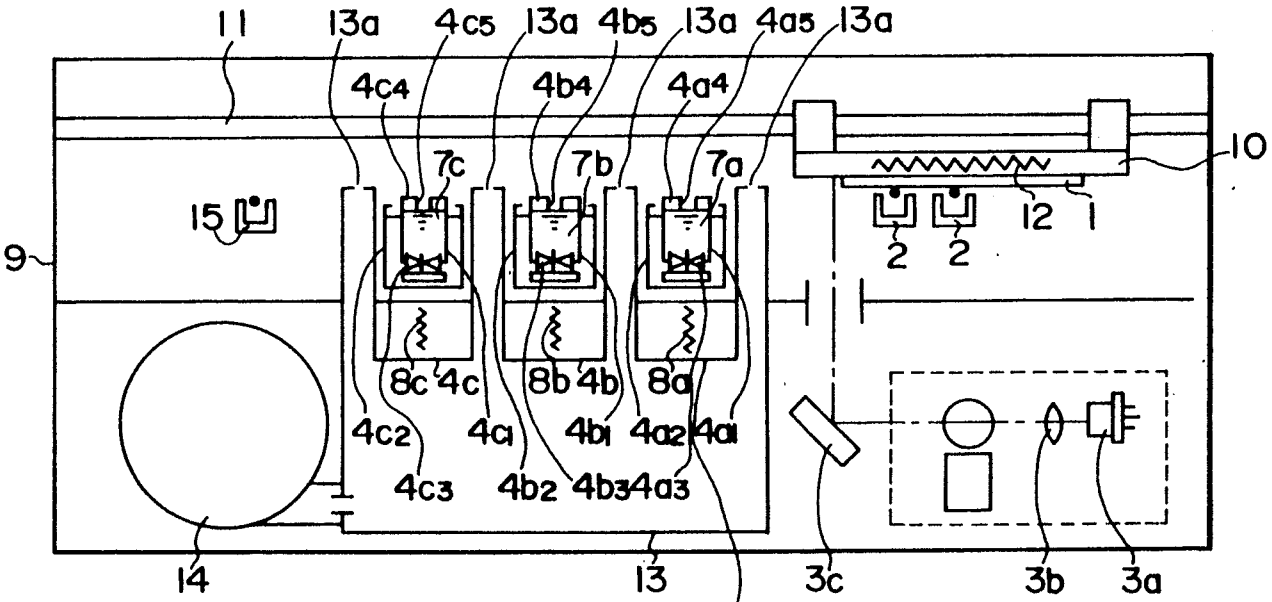
FIG. 17 is an enlarged cross-sectional view showing a developing apparatus employed in the examples of the present invention

The developing apparatus is formed by a electrostatic latent image forming section and a developing section, both accommodated in a single vessel 9, as shown in FIG. 17. The electrifying, exposure and the developing steps are carried out integratedly in that a stage 10 holding the sensitized material 1 is shifted along a guide rod 11.

The stage 10 holding the sensitized base material 1 is provided with heating means 12 adapted for heating the sensitize base material 1 to a predetermined temperature.

The latent image forming section is subdivided into an electrifying section and a light exposure section. In the electrifying section, the overall surface of the sensitized base material 1 is electrified to, for example, a negative change by an electrifying unit 2.

The light exposure section is made up of an optical system including a laser diode 3*a*, a lens 3*b* and a reflective mirror 3*c*. The section plays the role of selectively exposing the overall electrified surface of the sensitized material 1 as a function of signals to eliminate the charges of the portions thus exposed to light.

The developing section includes three developing tanks 4*a*, 4*b*, 4*c* containing three kinds of developer for full color developer, these tanks 4*a* to 4*c* being provided in this order in the direction of extension of the guide rod 11 within an air tank 13 provided with a blower fan 14.

The developing tanks 4*a*, 4*b* and 4*c* are composed of first tanks $4a_1$, $4b_1$ and $4c_1$ fitted with stirrers $4a_3$, $4b_3$ and $4c_3$ and second tanks $4a_2$, $4b_2$ and $4c_2$ provided around the outsides of the first tanks. Heating means 8*a*, 8*b* and 8*c* are provided on the bottom of the tanks.

The developers 7*a*, 7*b* and 7*c*, accommodated in these developing tanks 4*a*, 4*b* and 4*c*, are heated by the above heating means 8*a*, 8*b* and 8*c* to the melted state, and are adapted to be ejected slightly upward during development via slits $4a_5$, $4b_5$ and $4c_5$ formed in lids $4a_5$, $4b_5$ and $4c_5$ of the first tanks $4a_1$, $4b_1$ and $4c_1$ into contact with the sensitized base material 1.

Each tank 4*a*, 4*b*, 4*c* is separated from the other tanks by air ejected via air nozzles 13*a* provided extending from the air tank 13 to prevent color mixing.

The rear portion of the developing section is provided with a unit 15 for removing unnecessary electrical charges.

In the above described developing apparatus, the overall surface of the sensitized base material 1 is electrified to negative charges by the electrifying unit 2.

The base material 1 is then selectively exposed to light by the light exposure section such that the charges in the exposed portion are released to form a predetermined electrostatic latent image.

The sensitized base material 1 is then moved along the guide bar 11 to a position facing the developer tank 4*a*, as it is heated, and the latent image is developed by the developer contained in the tank 4*a*.

The base material 1 is then moved to the unit 15 where the unnecessary charges are removed.

The sensitized base material 1 is then again moved to the latent image forming section to undergo the sequential steps of electrification—light exposure—development by the developing tank 4*b*—charge removal—electrification—light exposure—development in the developing tank 4*c* and—charge removal to form a full color image.

Using the above described developing apparatus, a full-color image has been formed with the following developers A, B and C contained in the tanks 4*a*, 4*b* and 4*c*.

Developer A

The present developer A is the cyan-color electrostatic latent image developer.

0.625 g of Lionol Blue KX-F1 produced by Toyo Ink Co. Ltd., as colorant, and 0.5 g of IP 2825, isoparaffin solvent produced by Idemitsu Sekiyu Co. Ltd., were comminuted by the Fouver-Maler method to produce a paste. This paste was dispersed in 50 ml of a separate isoparaffin solvent "Isopar H" produced by Esso Inc. and admixed with 0.05 g of "Aluminum Oxide C" produced by Nippon Aerosil Co. Ltd., as the charge reinforcing agent and the resulting mixture was dispersed for 12 hours in a paint shaker together with alumina beads. The resulting dispersion was admixed with 9.5 g of a 50%-solution of "FR101", acrylic resin produced by the Mitsubishi Rayon Co. Ltd. in toluene, 0.025 g of zirconium naphthenate as the charge donor and 0.025 g of calcium naphthenate to produce a concentrated developing liquid.

Then, 120 ml of paraffin melting at 42 to 44° C. was previously melted at 70° C. and 5 ml of the concentrated developing liquid was dispersed in the solution to produce a blue color latent image developer.

Developer B

The present developer B is a yellow-colored electrostatic latent image developer.

0.5 g of Similar Fast Yellow 8GF produced by Dai Nippon Ink Co. Ltd., as colorant, and 0.5 g IP2825, isoparaffin solvent produced by Idemitsu Sekiyu Co. Ltd., were comminuted by the Fouver-Maler method to produce a paste. This paste was dispersed in 50 ml of a separate isoparaffin solvent "Isopar H" produced by Esso Inc. and admixed with 0.01 g of "Aerosil 200" Ultra fine particles of dry silica produced by Nippon Aerosil Co. Ltd., as the charge reinforcing agent and the resulting mixture was dispersed for 18 hours in a paint shaker together with glass beads. The method for preparing the concentrated developing liquid and the electrostatic latent image developer is similar to the method described in connection with the developer A.

Developer C

The present developer C is the magenta-color electrostatic latent image developer.

0.8 g of Simular Rodamin Y toner F, produced by the Dai Nippon Ink Co. Ltd. as the colorant and 0.5 g of linseed oil were comminuted by the Fouver-Maler method to produce a paste. This paste was dispersed in 50 ml of "Isopar H", an isoparaffin solvent produced by Esso Inc. and the dispersing operation was performed for 18 hours in a paint shaker together with glass beads.

The method for preparing the concentrated developing liquid and the latent image developer is the same as that described in connection with the developer A.

On the other hand, a sheet of transparent electrically conductive film (of 0.2 μm thickness) and a modified vinyl acetate resin (film thickness, 2 μm) were laminated on polyethylene terephthalate film (125 μm thick) and a photosensitive layer (film thickness, 8 μm) containing 2 mg of cyanine dye ("NK 2892" produced by Nippon Kanko Shikiso Co. Ltd.) as sensitizer was formed on the laminate to produce the sensitized base material 1. Since the image quality may be degraded when the developers solidify immediately after contact with the sensitized base material 1, the stage 10 for securing the base material 1 was heated to 55° C. by the heating means 12.

As a result, a satisfactory full-color image comparable in resolution and definition with a silver halide photograph is consistently obtained.

EXAMPLE 2

Figure 18:
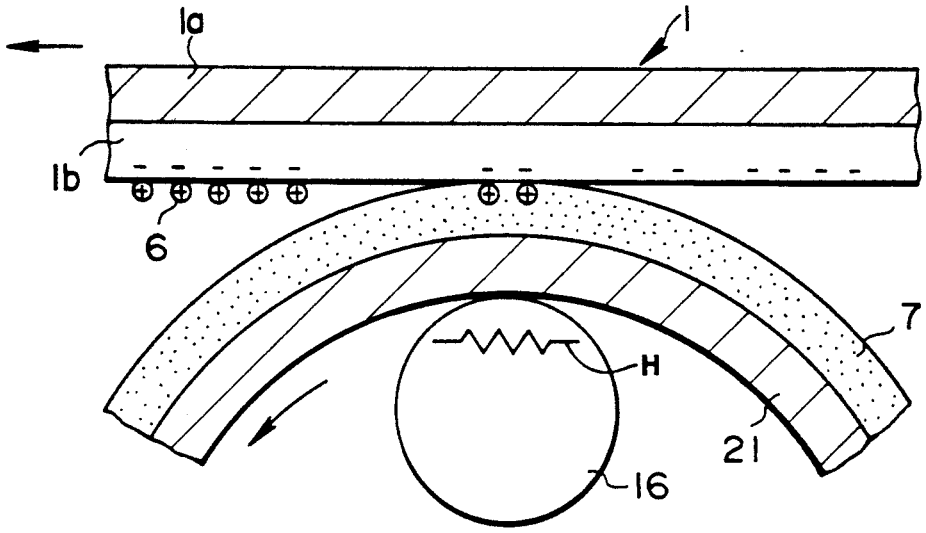
FIG. 18 shows diagrammatically the method for developing an electrostatic latent image by a developing material comprised of a base material and a developer held thereon.

A developing method for an electrostatic latent image will be hereinafter explained by reference to the example shown in FIG. 18 and using the developer of FIG. 2.

The sensitized base material 1 is comprised of a sheet-like base layer 1*a* and a photosensitive layer 1*b* formed on the base layer 1*a*. A latent image of the negative charges was formed on the layer 1*b* by the electrification and light exposure steps as a function of the image information.

For developing the base material 1 carrying the latent image of the negative charges by the developer of the present example, the base material is placed so that the developer 7 in the form of a layer on a backing 21 contacts with the layer 1*b* and is then fed under pressure applied by a roller 16 provided with heating means H. Of course, a pressure plate or other means is provided opposite the roller 16 so that pressure is exerted as the base 1 and developer 7 pass therebetween.

When the developer 7 and the photosensitive layer 1*b* are contacted with each other and heated by the roller 16, the developer 7 is liquefied and the colorants contained in the developer 7 migrate to and are deposited at the regions where the negative charges exist. The colorants affixed to unnecessary (uncharged) regions are then removed. The charge removing and fixing steps are then carried out to form the image on the sensitized base material 1. Since the image quality may be degraded when the developer solidifies immediately after contact with the sensitized base material 1, the sensitized base material 1 or the stage 10 for securing the base material 1 is preferably heated by heating means 12.

The present inventors tentatively produced the sheet-like developing material and developed an electrostatic latent image. It has been found that a satisfactory full-color image comparable in resolution and definition with the silver halide photograph could be obtained consistently.

EXAMPLE 3

A third developing method for an electrostatic latent image will be hereinafter explained with reference to FIG. 19 using the developer example shown in FIG. 5.

The sensitive base material 1 is comprised of a sheet-like base layer 1*a* and a photosensitive layer 1*b* formed on the base layer 1*a*. A latent image of the negative charges was formed on the layer 1*b* by the electrification and light exposure steps as a function of the image information.

For developing the base material 1 carrying the latent image of the negative charges by the developer of the present example, the base material is placed so that the developer 7 contacts with the layer 1*b* and pressure is applied by a roller 16 provided with heating means H as the base material 1 is fed past the roller 16.

When the developer 7 and the photosensitive layer lb are contacted with each other and heated by the roller 16, the developer 7 is liquefied and the colorant contained in the developer 7 migrates to and is deposited at the regions where the negative charges exist. The colorant affixed to the unnecessary region is then removed. The charge removing and fixing steps are then carried out to form the image on the sensitized base material 1. Since the image quality may be degraded if the developer solidified immediately after contact with the sensitized base material 1, the sensitized base material 1 or the stage 10 for securing the base material 1 is preferably heated by heating means 12.

Since the electrically conductive layer 24 is formed on the base material 21 a d.c. source 17 may be connected to the layer 24 to apply a bias voltage for development.

By application of this bias voltage, it becomes possible to control the relative potential of the latent image as well as to control the degree of fixing of the colorant 6 to the electrostatic latent image.

Figure 19:
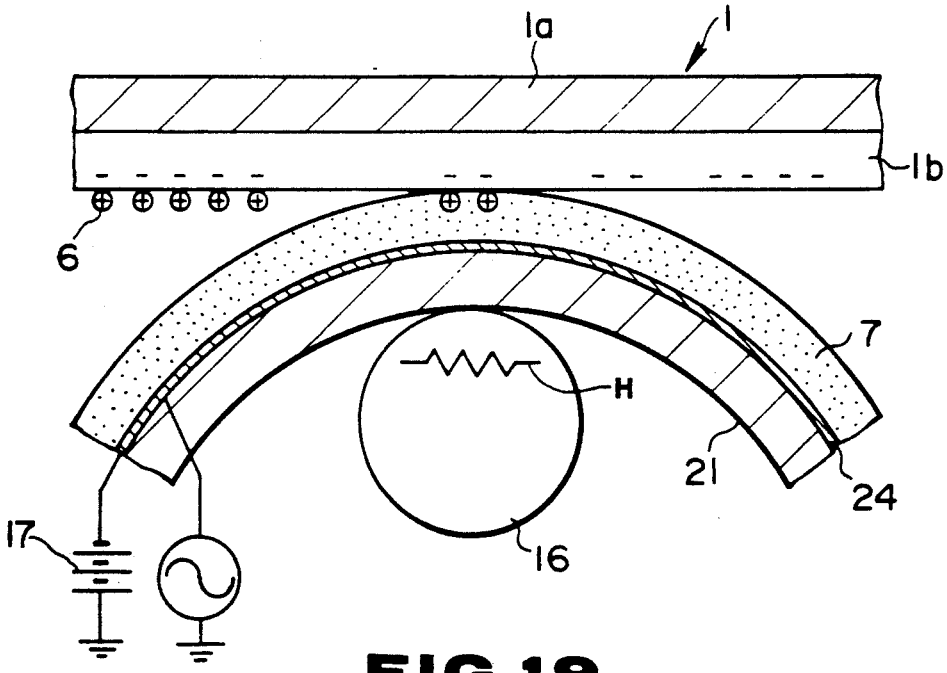
FIG. 19 shows diagrammatically the method for developing an electrostatic latent image with a developing material in which a developer is held on an electrically conductive substrate.

Both the bias voltage and an a.c. voltage may be applied to the layer 24 as shown in FIG. 19 to use the latter as the heating member to omit the heating means H for the roller 16. Since the electrically conductive layer 24 is formed of a thermally conductive material, such as metal, the heating temperature for the developer 7 may be advantageously equalized.

The present inventors tentatively produced the sheet-like developing material and developed an electrostatic latent image. It has been found that a satisfactory full-color image comparable in resolution and definition with a silver halide photograph can be obtained consistently.

EXAMPLE 4

In a further example, an electrostatic latent image developed by the developing apparatus, each developing liquid and a sensitized material the same as those of Example 1 was tentatively transferred to a substrate which was contacted with the sensitized material in the heated and melted state of the developer.

Figure 20A:
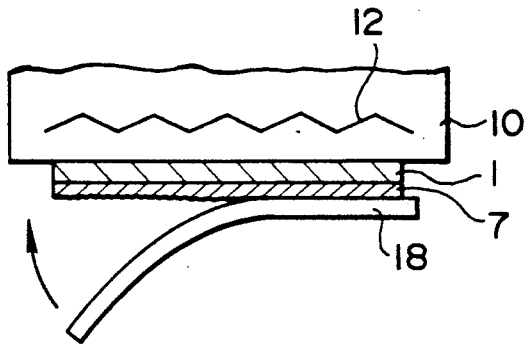
Figure 20B:
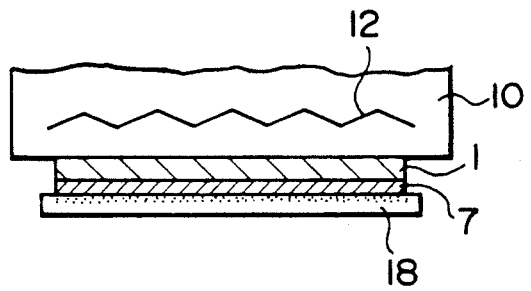
Figure 20C:
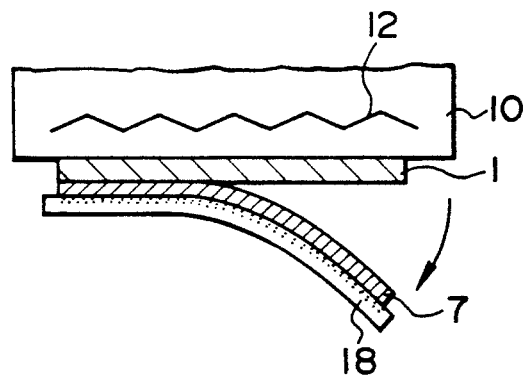

This transfer process is shown in FIGS. 20(A) to 20(C).

First, as shown in FIG. 20(A) the sensitized material 1, on which the electrostatic latent image was developed by selective affixture of the developer 7, was contacted with a substrate 18, such as ordinary paper. The sensitized material 1 is heated to a predetermined temperature by the heater 12 enclosed in the stage 10, so that the developer 7 is maintained in the heated and melted state. Thus, when contacted by the substrate 18, as shown in FIG. 20(B), the developer 7 is transferred readily onto the substrate and partially penetrates therein. Then, after the substrate 18 is separated from the sensitized material 1, the transfer operation is terminated and the image is formed on the substrate 18.

In this manner, a high quality image superior in gradation and resolution is produced with higher transfer efficiency. Image formation is accelerated since the full-color image is formed at once without the necessity of repeating the transfer process for each of the three primary colors. The sensitized material 1 after transfer may be used repeatedly.

EXAMPLE 5

In the present example, the image is transferred onto a substrate by contacting the sensitized material and the substrate with each other in the cooled and solidified state of the developer.

The developing apparatus, each developing liquid and the sensitized material are the same as those used in Example 1.

Figure 21A:
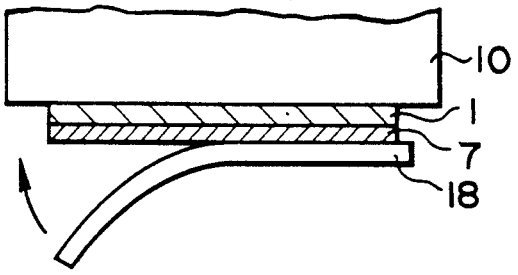
Figure 21B:
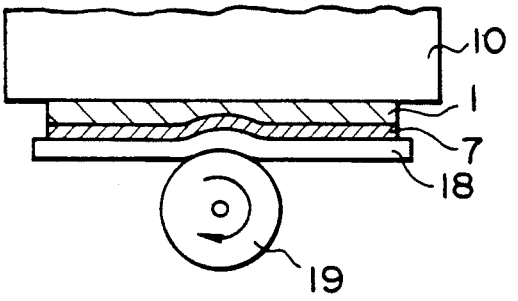
Figure 21C:
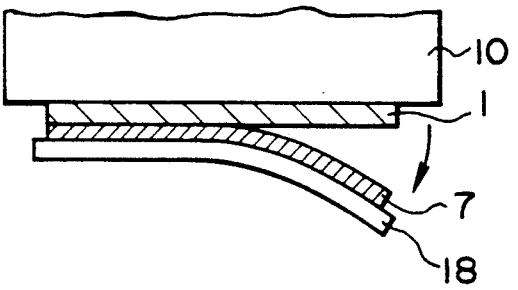

First, as shown in FIG. 21(A), the sensitized material 1 on which the image has been formed by selective affixture of the developer 7, is contacted with a substrate 18, such as ordinary paper. Since the developer 7 is in the cooled and solidified state at this time, the sensitized material 1 and the substrate 18 are contacted sufficiently intimately by pressure means, such as roller 19, as shown in FIG. 21(B). The substrate 18 is then separated from the sensitized material 1, as shown in FIG. 21(C), so that the developer 7 is transferred to the substrate 18 to complete the image transfer.

The result was satisfactory, as in Example 4.

Although the formation of full color images has been explained in the above examples, it is to be noted that the present invention may also be applied to the formation of monochromatic images.

EXAMPLE 6

Using the developing apparatus, developing liquids and the sensitized material the same as those of Example 1, the electrostatic latent image was formed on the sensitized material 1, and the sensitized material was contacted with the substrate in the heated and melted state of the developer to transfer the image on the substrate.

Figure 22A:
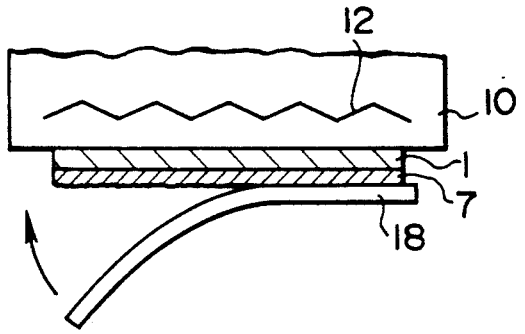
Figure 22B:
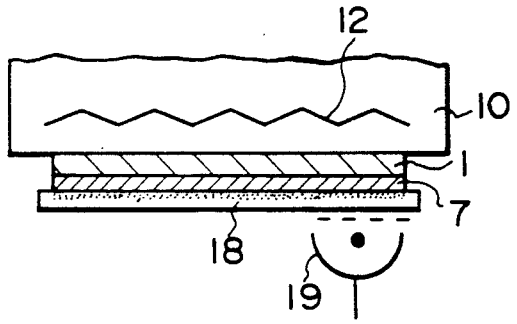
Figure 22C:
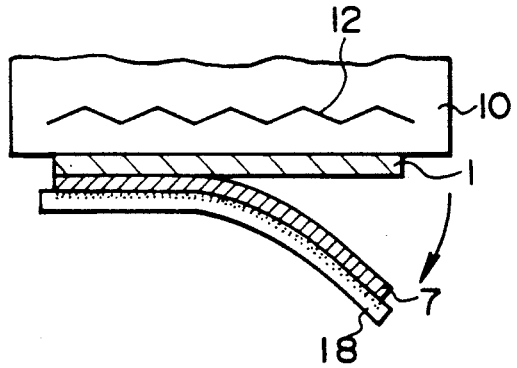
Figure 23:
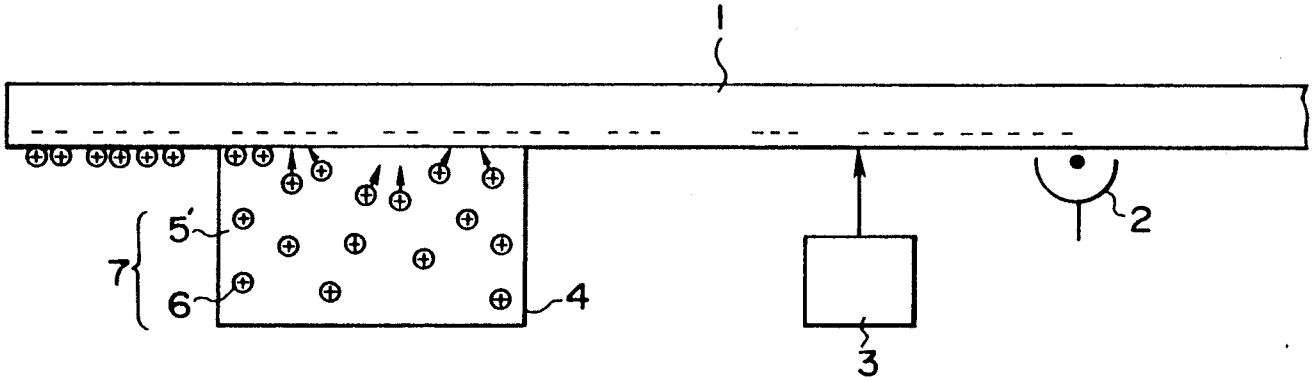
FIG. 23 (PRIOR ART)
FIG. 23 shows a prior art system.

This transfer process is explained in detail by referring to FIGS. 22(A) to 22(C).

First, as shown in FIG. 22(A), the sensitized material 1, on which the electrostatic latent image was developed by selective affixture of the developer 7, is contacted with the substrate 18, such as ordinary paper. The sensitized material 1 is heated to a predetermined temperature by the heater 12 enclosed in the stage 10, so that the developer 7 is maintained in the heated and melted state. Thus, when contacted by the substrate 18, as shown in FIG. 20(B), the developer 7 is transferred readily onto the substrate 18 and partially penetrates therein. In this state, the substrate 18 opposite to the sensitized material 1 is charged by, for example, corona discharge by charging means 19, to the opposite polarity of the positive charges of the colorant particles 6. In the present example, the substrate 18 is electrified to negative charges of −6 kV.

The colorant particles 6 are attracted in this manner towards the substrate 18 by these charges of the opposite polarity. As a result, transfer of the developer 7 onto the substrate 18 is accelerated and the developer 7 may be moved readily onto the substrate 18.

Then, as shown in FIG. 22(C), the substrate 18 is separated from the sensitized material 1 to complete the transfer and the image may thus be formed on the substrate 18.

Then, as shown in FIG. 22(C), the substrate 18 is separated from the sensitized material 1 to complete the transfer and the image may thus be formed on the substrate 18.

In this manner, a high quality image that is superior in gradation and resolution is produced with higher transfer efficiency. Image formation is accelerated since the full-color image can be formed at once without the necessity of repeating the transfer process for each of the three primary colors. The sensitized material 1 after transfer may be used repeatedly.

Although the case of formation of the full-color image has been explained in the above examples it is noted that the present invention may also be applied to formation of monochromatic images.

EXAMPLE 7

In the present example, an electrostatic image is formed, using a sensitized material comprised of a laminated polyethylene film as the electrically conductive film, the latent image is developed by a cyan-color developer, and the polyethylene film was peeled from the sensitized material and bonded to ordinary paper.

A sheet of a transparent electrically conductive film (0.2 m thick) and a modified vinyl acetate resin (film thickness, 2 m) were laminated on polyethylene terephthalate film (125 μm thick) and a photosensitive layer (film thickness, 8 μm) containing 2 mg of cyanine coloring matter ("NK 2892" produced by Nippon Kanko Shikiso Co. Ltd.) as a sensitizer was formed on the laminate to produce the sensitized base material. The dark decay time of the sensitized material is 300 seconds. A polyethylene film 9 μm thick was laminated as an electrically conductive film on this sensitized material.

The developer used in this example is the aforementioned electrostatic latent image developer previously proposed by the present Applicant. This developer was prepared in the following manner.

First, 0.625 g of Lionol Blue KX-F1 produced by Toyo Ink Co. Ltd., as a colorant, and 0.5 g of IP 2825, isoparaffin solvent produced by Idemitus Sekiyu Co. Ltd., were comminuted by the Fouver-Maler method to produce a past. This paste was dispersed in 50 ml of a separate isoparaffin solvent "Isopar H" produced by Esso Inc. and the resulting mixture was dispersed for 12 hours in a paint shaker together with alumina beads. The resulting dispersion was admixed with 0.5 g of a 50%-solution of "FR101", acrylic resin produced by the Mitsubishi Rayon Co. Ltd. in toluene, 0.025 g of zirconium naphthenate and 0.025 g of calcium naphthenate as the charge donor to produce a concentrated developing liquid. Then, 120 ml of paraffin melting at 42° to 44° C. was previously melted at 70° C. and 5 ml of the concentrated developing liquid was dispersed in the solution to produce a cyan color latent image developer.

In forming an image, a sensitized material comprised of a laminated polyethylene film 20 as shown in FIG. 13 is subjected to corona discharge 2 at −6 kV so as to be charged to −700 V in its entirety. The sensitized material is then subjected to selective light exposure by a semiconductor laser 3 of a wavelength of 780 nm to form an electrostatic latent image. Then, as the developer 7 is heated by suitable heating means, not shown, provided on the developer tank 4, for example, for maintaining the developer 7 in the melted state the electrostatic latent image was developed for forming an image on the polyethylene film.

With the time $t_1$ involved in corona charging of 3 seconds, the time $t_2$ from corona charging until exposure being 2 seconds, the time $t_3$ for exposure of 3 seconds and the time $t_4$ from exposure until development being 2 seconds, the total time amounts to 10 seconds. The 9 μm thick polyethylene film used as the electrically conductive film in the present example has the dark decay time at 25° C. of about 6.5 seconds, thus satisfying the requirement that the dark decay time be shorter than the total time t.

After the fixation and charge removal steps, the polyethylene film is peeled from the sensitized material 1 and bonded to an ordinary paper sheet to transfer the image thereto The image, thus, transferred to the ordinary paper sheet showed high resolution of 500 lines/mm or 1000 dots/mm and excellent gradation. Since the electrically conductive film in its entirety is bonded to the substrate, the transfer efficiency is 100%, while the sensitized material can be used repeatedly.

Although the case of forming a cyan-color monochromatic image has been explained in the present example, it is to be noted that the present invention can be applied to formation of a full-color image as well. For forming the full-color image, the steps of electrification, light exposure and charge removal are repeated for each of the three primary colors for the same sensitized material and the transfer operation is then performed collectively. The sensitized material may used repeatedly after the transfer operation.

EXAMPLE 8

In the present example, a sensitized material comprised of a film of a polyvinylidene chloride-vinyl chloride copolymer, referred to hereinafter as Saran film, as the electrically conductive film is used. The Saran film is heated to about 50° C. to form an electrostatic latent image, and this latent image was developed by using a cyan color developer and the Saran film was then peeled off from the sensitized material and bonded on the ordinary paper sheet.

The developer and the sensitized material used herein are the same as those used in Example 7.

For forming the image, a 10 μm thick Saran film was laminated on the sensitized material and heating was then performed by heating means provided on a stage, not shown, adapted for supporting the sensitized material, so that the temperature of the Saran film was about 50° C. This Saran film has a glass transition point Tg of 10° C. and a longer dark decay time at room temperature (25° C.) of not shorter than 300 seconds, so that it can be applied only with difficulty to the present invention. This dark decay time could be reduced to 6.6 second by heating to about 50° C. as described above. This is shorter than the dark decay time of the sensitized material employed in the present example, which is 300 seconds, or the time t from corona charging until development, which is 10 seconds.

The corona discharge is then performed at −6 kV to electrify the overall surface of the Saran film to about −700 V. Then, selective light exposure is performed with a semiconductor laser image. Then, as the developer 7 is heated by suitable heating means, not shown, provided on the developer tank 4, for example, for maintaining the developer in the melted state the electrostatic latent image is developed for forming an image on the Saran film.

After the fixation and charge removal steps, the Saran film is peeled from the sensitized material and bonded to an ordinary paper sheet to transfer the image thereto The image thus transferred to the ordinary paper sheet showed high resolution of 500 lines/mm or 1000 dots/mm and excellent gradation. Since the electrically conductive film in its entirety is bonded to the substrate, the transfer efficiency is 100%, while the sensitized material can be used repeatedly For comparison, a similar image was tentatively formed at room temperature, but a satisfactory image quality could not be obtained.

Although the case of forming a cyan-color monochromatic image has been explained in the present example it is to be noted that the present invention can be applied to formation of a full-color image as well. For forming the full-color image, the steps of electrification, light exposure and charge removal are repeated for each of the three primary colors for the same sensitized material and the transfer operation may then be performed collectively. The sensitize material may be used repeatedly after the transfer operation.

EXAMPLE 9

In the present example, an electrostatic latent image is formed by using a sensitized material comprised of a laminated PET film as an insulating film, this latent image is developed with a cyan-color developer and the PET film is peeled off from the sensitized material and bonded to an ordinary paper sheet.

The developer and the sensitized material employed herein are the same as those used in Example 7.

In forming an image, a sensitized material comprised of a 9 μm thick laminated polyethylene film (dark decay time, 300 seconds) is subjected to corona discharge at −6 kV so as to be charged to −700 V in its entirety. The sensitized material is then subjected to selective light exposure by a semiconductor laser of a wavelength of 780 nm to form an electrostatic latent image. Then, as the developer is heated by suitable heating means, not shown, provided on the developer tank, for maintaining the developer in the melted state, and as the bias voltage of −400 V is applied to the developer to prevent wasteful deposition of colorant particles due to the residual potential at the light exposure section, the electrostatic latent image is developed to form an image on the PET film.

After the fixation and charge removal steps, the polyethylene film is peeled from the sensitized material and bonded to an ordinary paper sheet to transfer the image thereto.

The image thus transferred to the ordinary paper sheet showed high resolution of 500 lines/mm or 1000 dots/mm and excellent gradation. Since the electrically conductive film in its entirety is bonded to the substrate, the transfer efficiency is 100%, while the sensitized material can be used repeatedly.

Although the case of forming a cyan-color monochromatic image has been explained in the present example, it is to be noted that the present invention can be applied to formation of a full-color image as well. For forming the full-color image, the steps of electrification, light exposure and charge removal are repeated for each of the three primary colors for the same sensitized material and the transfer operation may then be performed collectively. The sensitized material may be used repeatedly after the transfer operation.

EXAMPLE 10

In the present example, an electrostatic latent image is formed by using a sensitized material comprised of a laminated polyethylene film, this latent image is developed with a cyan-color developer and the polyethylene film is peeled off from the sensitized material bonded to an ordinary paper sheet.

The developer and the sensitized material employed herein are the same as those used in example 7.

In forming the image, a sensitized material comprised of a laminated 9 μm thick polyethylene film having a contact angle of 45° with respect to methylene iodide is subjected to corona discharge and thereby charged in its entirety to negative polarity. Then, selective light exposure is performed by a semiconductor laser to form an electrostatic latent image on the polyethylene film. Then, as the developer is heated by heating means, not shown, provided for a developing tank for maintaining the developer in the melted state, and as the bias voltage of −400 V is applied to the developer to prevent wasteful deposition of colorant particles due to the residual potential at the light exposure section, the electrostatic latent image is developed to form an image on the polyethylene film. The developing time is about three seconds. After the subsequent fixation and charge removal steps, the polyethylene film is peeled off from the sensitized material and bonded to the ordinary paper sheet to transfer the image thereto.

The image thus transferred to the ordinary paper exhibited high resolution and gradation.

Then, by way of a comparative example, a film having a contact angle of not less than 60° with respect to methylene iodide was used as the film laminated on the sensitized material, and the image was formed on the film under the same conditions as in Example 10 and transferred to an ordinary paper sheet. As the film having the contact angle of not less than 60° with respect to methylene iodide, polyvinylidene fluoride (contact angle, 63°) and polytrifluoroethylene (contact angle, 71°) were used.

The image obtained with the use of these films having the contact angle with respect to methylene iodide not less than 60° was inferior in resolution or gradation to that obtained with the use of a film having the contact angle with respect to methylene iodide of not more than 60°.

Since these images are bonded along with the films onto the ordinary paper sheet, the transfer efficiency is 100% and the sensitized material can be used repeatedly.

Although the case of forming the cyan color monochromatic image has been explained in the present example it is to be noted that the present invention may be applied to formation of full-color images.

Although other modifications and changes may be suggested by those skilled in the art, it is the intention of the inventors to embody within the patent warranted hereon all changes and modifications as reasonably and properly come within the scope of their contribution to the art.

We claim:

1. An electrophotographic process, comprising the steps of:

charging electrically a sensitized base material to a first polarity by a charging means;

exposing selectively a portion of said sensitized base material which does not correspond to an image information to be developed by an exposure means, melting a developer comprised of an electrically insulating organic material and pigment particles dispersed therein, said pigment particles being charged to a second polarity opposite to said first polarity, said pigment particles maintaining said second polarity throughout the electrophotographic process, said insulating organic material being solid at ambient temperature and being capable of transforming between a solid state and a liquid state when heated and cooled, said developer comprising developer in a plurality of colors being held on a base material with the colors separated in separate zones of said base material, and contacting the molten developer with said substrate by superimposing the base material on which the molten developer is held onto said substrate for affixing said pigment particles to the portion of said sensitized base material where said electrostatic latent image has been formed.

2. An electrophotographic process as claimed in claim 1, wherein said separate zones in which said plurality of colors is held are separated from one another by color mixing inhibitor layers.

3. An electrophotographic process, comprising steps of:

laminating a film on a photoconductor, the film being capable of transmitting light from an exposure light source, electrifying a surface of said film corresponding to image information and by elimination of said electrical charge on an exposed portion, developing said electrostatic latent image by contacting a developer melted by heating means with said film carrying said electrostatic latent image, said developer consisting essentially of colorant particles charged to a polarity opposite to said electrical charge of said film and dispersed in an electrically insulating organic material which is solid at ambient temperature and changes between a solid state and a liquid state when heated and cooled, respectively, said colorant particles maintaining said opposite polarity throughout the electrophotographic process, said colorant particles being affixed on and developing said electrostatic latent image, and peeling said film from said photoconductor; wherein the film is an electrically conductive film having a dark decay time shorter than that of the photoconductor; wherein said film has a contact angle with respect to methylene iodide of not more than 60 degrees.

4. An electrophotographic process, comprising the steps of:

charging electrically a sensitized base material to a first polarity by a charging means;

exposing selectively a portion of said sensitized base material which does not correspond to an image information to be developed by an exposure means, melting a developer comprised of an electrically insulating organic material and pigment particles dispersed therein, said pigment particles being charged to a second polarity opposite to said first polarity, said pigment particles maintaining said second polarity throughout the electrophotographic process, said insulating organic material being solid at ambient temperature and being capable of transforming between a solid state and a liquid state when heated and cooled, and contacting the molten developer with said substrate for affixing said pigment particles to the portion of said sensitized base material where said electrostatic latent image has been formed, wherein the contacting step is so performed that a developing material comprised of said developer held on a vase material is superimposed on said substrate carrying said electrostatic latent image and fed as it is pressured by a roller fitted with heating means, wherein the developing material carries a plurality of developers in different regions on the base material thereof, said developers containing colorants of different coloration dispersed therein.

5. A process according to claim 4, wherein a developing material is used in which a color mixing inhibit layer is formed between the developers of the respective regions.

6. An electrophotographic process, comprising steps of:

laminating a film on a photoconductor, the film being capable of transmitting light from an exposure light source, electrifying a surface of said film corresponding to image information and by elimination of said electrical charge on an exposed portion, developing said electrostatic latent image by contacting a developer melted by heating means with said film carrying said electrostatic latent image, said developer consisting essentially of colorant particles charged to a polarity opposite to said electrical charge of said film and dispersed in an electrically insulating organic material which is solid at ambient temperature and changes between a solid state and a liquid state when heated and cooled, respectively, said colorant particles maintaining said opposite polarity throughout the electrophotographic process, said colorant particles being affixed on and developing said electrostatic latent image, and peeling said film from said photoconductor; wherein the film is an electrically conductive film having a dark decay time shorter than that of the photoconductor, wherein the electrically conductive film is heated.

* * * * *